United States Patent [19]

Boley

[11] 4,335,740

[45] Jun. 22, 1982

[54] WELLHEAD BUNKER

[75] Inventor: Jack W. Boley, Grapevine, Tex.

[73] Assignee: Texas Oil and Gas Corporation, Dallas, Tex.

[21] Appl. No.: 97,171

[22] Filed: Nov. 26, 1979

[51] Int. Cl.[3] ..... F16L 5/00; E02D 29/14

[52] U.S. Cl. ..... 137/364; 52/20

[58] Field of Search ..... 52/19–21; 137/363, 364; 166/75 R, 96

[56] References Cited

U.S. PATENT DOCUMENTS

| | | | |
|---|---|---|---|
| 1,488,211 | 3/1924 | Loeffler | 251/266 |
| 2,604,168 | 7/1952 | Ackeren | 166/68.5 |
| 2,706,004 | 4/1955 | Katzenmaier | 248/354 |
| 3,063,500 | 11/1962 | Logan | 166/96 |
| 3,112,760 | 12/1963 | Budd | 137/363 |
| 3,367,071 | 2/1968 | MacLaren | 52/21 |
| 3,370,386 | 2/1968 | Martin | 52/19 |
| 3,461,803 | 8/1969 | Stothoff et al. | 52/20 |
| 3,521,537 | 7/1970 | Forni et al. | 52/20 |

*Primary Examiner*—A. Michael Chambers

*Attorney, Agent, or Firm*—Richards, Harris & Medlock

[57] ABSTRACT

In the production and delivery of oil and/or gas from a well, a wellhead (10) is completely enclosed within a bunker (28) equipped with a sump line (30) and ladders (62). A top cover (36) encloses the upper end of the bunker (28) and is supported on structure (38). Vents (32) and (34) are included as a part of the top cover (36) to provide ventilation through the bunker (28).

3 Claims, 4 Drawing Figures

WELLHEAD BUNKER

TECHNICAL FIELD

This invention relates to apparatus for the production of oil and/or gas from a well through production tubing, and more particularly to apparatus for the production of oil and gas to minimize environmental impact.

BACKGROUND ART

In the development, exploration and marketing of oil and gas there is increasing concern about the environmental impact of such activity. Leaseholders of oil and gas mineral rights are being required to conduct drilling, well completion, and subsequent operation in compliance with county, state and federal rules and regulations, together with whatever rules and regulations proposed and adopted by the landowner to prevent interference with normal surface activity. Special drilling techniques have been developed to enable the tapping of gas or oil reserves underlying otherwise inaccessible areas. Where such drilling tests are successful and show reserves of oil and/or gas of commercial quantities production facilities, including the wellhead (referred to in the trade as a Christmas tree) must also meet with the environmental impact requirements.

In accordance with the present invention, a well location, and in particular production apparatus at the wellhead, will be constructed to minimize the environmental impact. A wellhead is bunkered below the surface of the ground thereby enabling a near normal use of the surface rights of the landowner.

In addition to minimizing environmental impact, the apparatus of the present invention provides improved protection of wellhead equipment from damage or destruction.

Heretofore, in the production of gas through production tubing from a well, the wellhead was positioned above ground usually in an unprotected condition. Such exposed wellheads are subject to corrosion from the elements and are also subject to vandalism and abuse when left unprotected. Considering the number of presently producing gas wells and the location of many of such wells, there has occasionally been a problem caused by abuse of such exposed wellheads. In accordance with the present invention, the wellhead is in a protected bunker below ground level and is not only protected from the elements and vandalism or abuse, but also may be concealed so that its presence is unknown. Further, the surrounding area is unobstructed with conventional wellhead equipment.

DISCLOSURE OF THE INVENTION

In accordance with the present invention, there is provided apparatus for use in delivery of oil and/or gas from a well through production tubing into a distribution system. A bunker having an open top and substantially submerged into the earth is positioned to surround the production tubing at near the upper end thereof. A wellhead is attached to the production tubing in such a manner so as to be completely enclosed within the bunker. A top support structure is attached to the bunker at a position slightly recessed from the top of the bunker walls. This support structure provides a means to hold a cover that is dimensioned to fit within the top of the bunker in such a position so that there is a clearance between the top of the wellhead and the cover. At least two access openings are formed in the cover for entry into the bunker for periodic maintenance and inspection. A hatch door is hinged to the cover or to the bunker walls for each of the access openings and in a closed position seals off the interior of the bunker for protection against the elements.

To provide ventilation through the bunker to prevent any accumulation of gas, at least one vent is positioned in the cover.

Also for the purpose of maintenance, a sump line is attached to the bunker and has one open end termining at near the bottom thereof and a second open end extending from the container at a position above ground level.

BRIEF DESCRIPTION OF THE DRAWINGS

For a more complete understanding of the present invention and the advantages thereof, reference is now made to the following description taken in conjunction with the accompanying drawings.

Referring to the drawings.

DETAILED DESCRIPTION OF THE INVENTION

Figure 2:
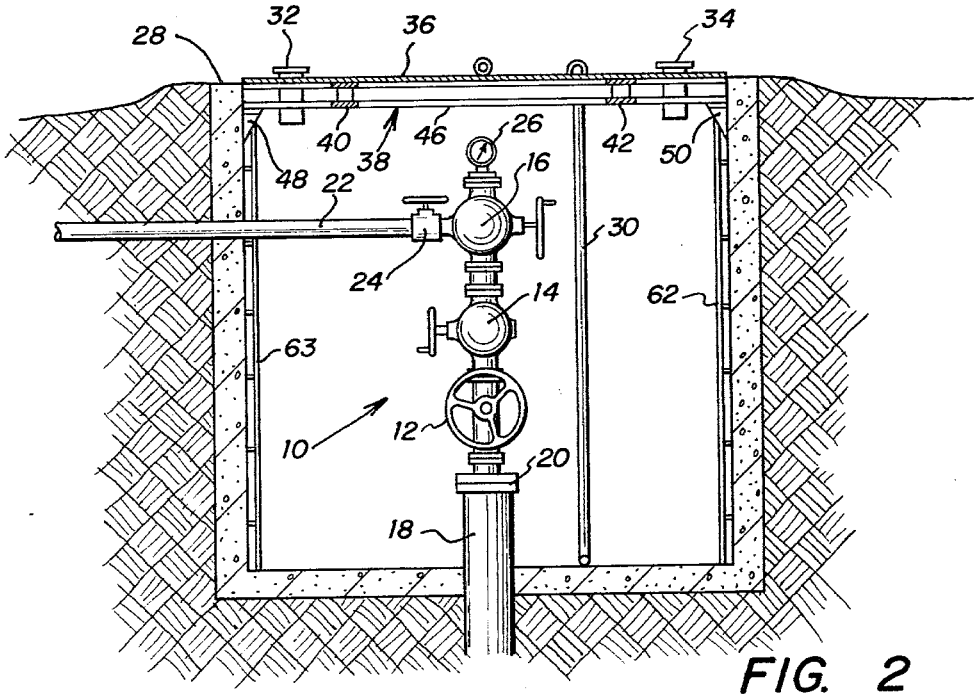
FIG. 2 is a cross sectional view of the apparatus of FIG. 1 including a reinforced concrete bunker with an boiler plate cover.

Referring to FIG. 2, apparatus for the production of gas and/or oil from a well includes a protective system for the wellhead 10, sometimes known as a "Christmas tree". The wellhead 10 is of conventional construction including interconnected valves 12, 14 and 16 with a valve 12 attached to production tubing 18 by means of a flange 20. A collection line 22 is coupled to the valve 16 by means of a shutoff valve 24. The collection line 22 extends to a high or low pressure distribution system for delivery of gas from the well to a distribution network. Also included as part of the conventional valving arrangement is a pressure gauge 26.

Figure 1:
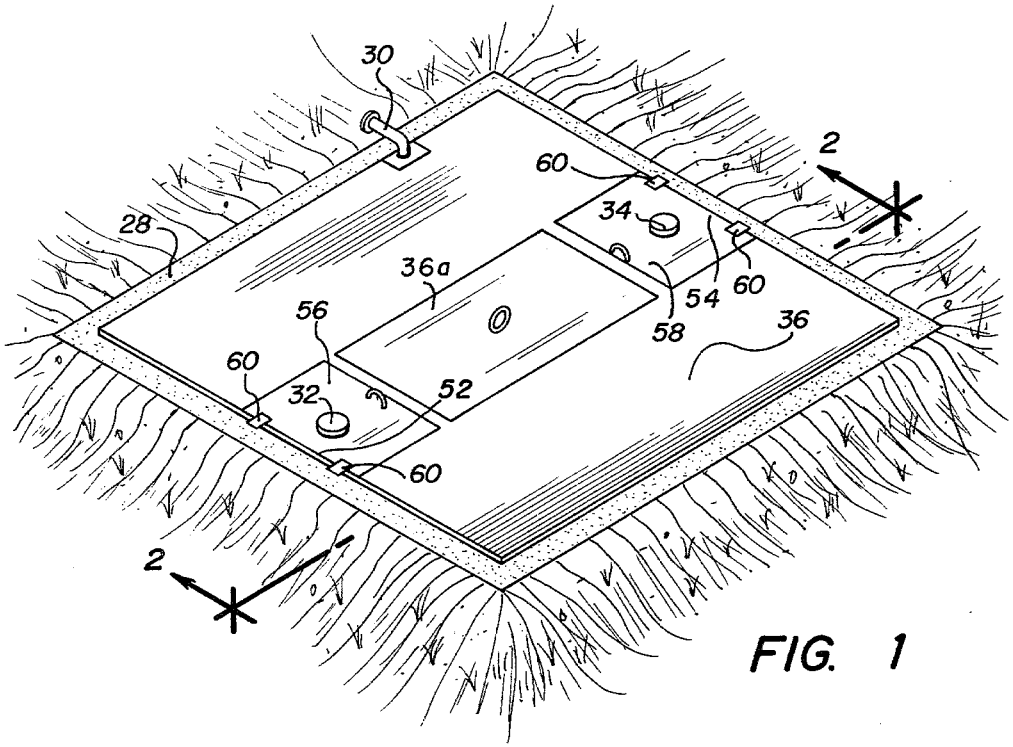
FIG. 1 is a pictorial view of an installation of one embodiment of apparatus for the production and delivery of gas and/or oil from a well.
Figure 3:
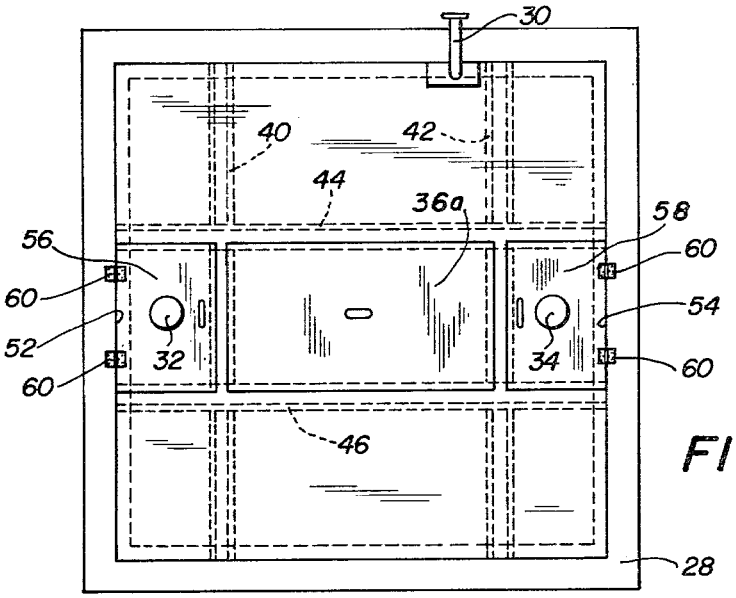
FIG. 3 is a top view of the bunker of FIG. 2 showing supporting structure for the boiler plate cover.

All of the above valving and piping arrangement is completely enclosed within a bunker 28 which is illustrated in FIGS. 1–3 as a reinforced concrete structure, that is, a poured concrete structure with reinforcing iron bars distributed throughout the concrete. Typically, the bunker 28 is a 10 foot cube, that is, 10 feet along each side and 10 feet deep. The size of the bunker will be determined for each individual installation depending on the size of the wellhead apparatus 10 and the amount of space required to service the wellhead.

As best illustrated in FIG. 2, the bunker 28 is equipped with a sump line 30 having one open end at the bottom of the bunker and a second open end extending above ground. The purpose of the sump line 30 is to remove any water accumulation from the bunker prior to servicing the well. Any conventional pump may be connected to the sump line for removal of the water accumulation. In addition, the sump line provides air circulation in the bunker in conjunction with vents 32 and 34 located in the top cover 36. The vents 32 and 34 themselves are sufficient to provide an airflow through the bunker interior to prevent the accumulation of gas resulting from a leakage at the wellhead.

Typically, the top cover 36 is a steel plate that is supported on an I-beam support structure 38. As best illustrated in FIG. 3, the I beam support structure includes cross beams 40, 42, 44 and 46 welded or otherwise interconnected into a unitary assembly. The ends of each of the I-beams 40, 42, 44 and 46 are supported by means of brackets, such as brackets 48 and 50 attached to the side walls of the bunker 28, as shown in FIG. 2. As illustrated, the brackets 48 and 50 are attached to the side walls of the bunker 28 such that the top cover 36 is substantially at the level of the top edge of the bunker walls.

Referring now to FIG. 1, at the center of the top cover 36 there is provided a service cover 36*a* which is removable to service the wellhead 10.

Also included as part of the top cover 36 are access openings 52 and 54 that are normally closed by cover plates 56 and 58, respectively. The cover plates 56 and 58 are attached to the side walls of the bunker 28, such as by hinges 60. Alternatively, the cover plates 56 and 58 could be hinged to the top cover 36.

As illustrated in FIG. 3, the vents 32 and 34 are located in the cover plates 56 and 58, respectively. However, it should be understood that the vents may be positioned anywhere within the top cover 36. In a typical installation the vents may be located to take the maximum advantage of the prevailing wind conditions at the well site to provide maximum ventilation of the bunker 28.

As best illustrated in FIG. 2, attached to a side wall of the bunker 28 is a ladder 62 positioned such that the top thereof is in the vicinity of the access opening 54. A similar such ladder (not shown) will be attached to the side wall of the bunker 28 in the vicinity of the access opening 52.

As mentioned previously, the apparatus of the present invention, as illustrated in FIGS. 1–3, is for the production and delivery of gas and/or oil to a distribution system and provides the advantage of minimizing the environmental impact and reducing the probability of damage to the wellhead 10 by destructive acts. However, all wellheads must be periodically serviced and the servicing of the wellhead 10 is made possible by the access openings 52 and 54. To minimize the possibility of a service person being trapped in the bunker 28, at least two access openings are provided in the top cover 36. When both these access openings are uncovered, there is also a greater likelihood that any gas accumulated within the bunker 28 will escape. As an extra precautionary measure it may be necessary to provide forced air ventilation by inserting a hose connected to a portable compressor into the bunker 28 through one of the access openings to force out any accumulated gases. After the bunker 28 has been purged of all gas accumulation, which can be measured by a conventional gas detector, a service person may enter the bunker 28 to inspect the wellhead and the various valves 12, 14 and 16 and also record a pressure reading from the gauge 26. The multiple access openings provide alternate exit routes from the bunker 28 should an emergency situation develop blocking one of the openings.

Figure 4:
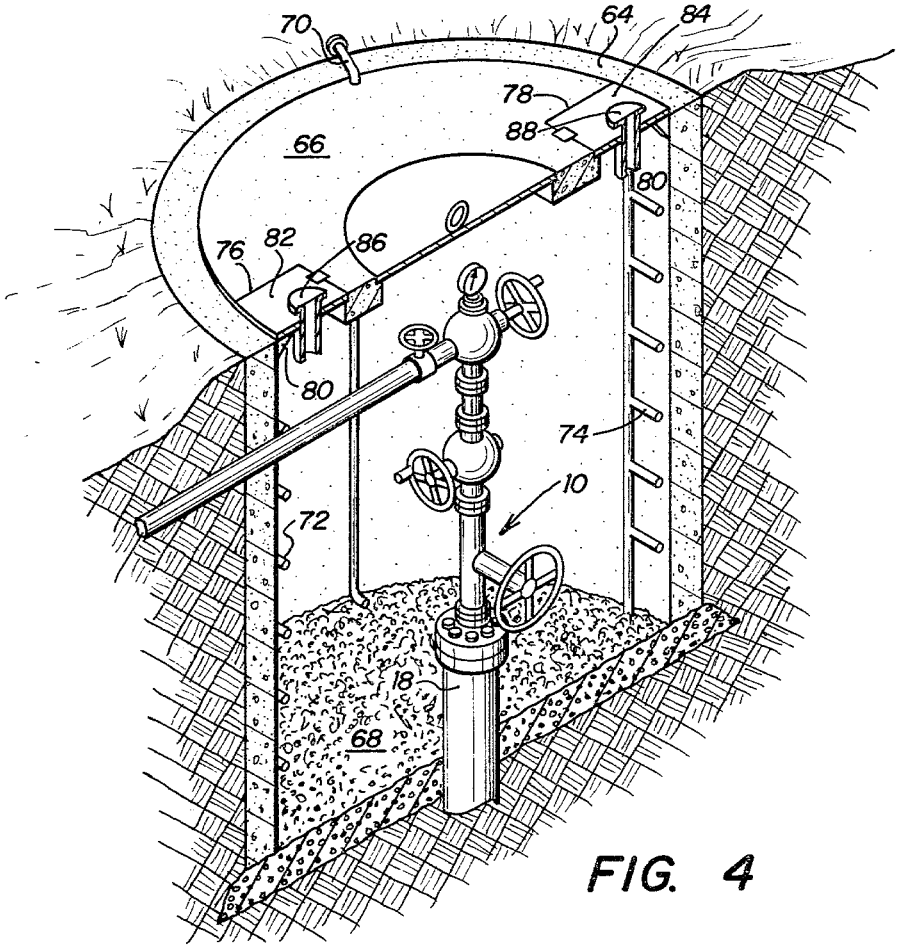
FIG. 4 is a pictorial view in section of an alternate embodiment of a bunker for apparatus for the production and delivery of gas and/or oil through production tubing from a well.

Referring to FIG. 4, there is shown an alternate embodiment of the invention including a cylindrical shaped bunker 64 having a top end enclosed by a cover 66 and an open bottom. The bottom of the bunker 64 surrounding the production tubing 18 is covered with a layer of loose rock 68. The loose rock prevents the build up of an accumulation of water within the bunker 68 under normal conditions. However, the embodiment of FIG. 4 is equipped with a sump line 70 for removing any accumulation of water that may not naturally drain from the bunker 64.

In the embodiment of FIG. 4, the section is taken along a line to show that the bunker 64 is equipped with ladders 72 and 74 on opposite sides of the bunker as was described with reference to the embodiment of FIGS. 1–3. The top cover 68 is shown as a reinforced concrete slab equipped with access openings 76 and 78 and supported on brackets 80. The access openings 76 and 78 are equipped with cover plates 82 and 84 which typically may be ½ inch steel boiler plate. As an alternative to hinging the cover plates 82 and 84 to the top cover 66, the top plates are shown supported on a lip 82*a* and 84*a* for the respective cover plate. Again, the apparatus of FIG. 4 is equipped with vents 86 and 88.

While generally the bunkers of the present invention will be constructed in place, the bunker 64 of FIG. 4 may be constructed off site and hauled to the well location and then buried to the desired depth. Although in the figures so far described the bunkers have been shown constructed of reinforced concrete, steel plate may also be utilized in the bunker construction. The use of steel plate permits the prefabrication of the entire bunker at an off site location and assembly thereof at the well location.

Whether the bunker is constructed as shown in FIGS. 1–3 or as shown in FIG. 4, or in some other suitable configuration, the purpose thereof is the same. That is, the protection of the wellhead 10 and the minimization of the environmental impact for the production and delivery of gas and oil from a well.

While several embodiments of the invention have been described in detail herein and shown in the accompanying drawings, it will be evident that various further modifications are possible without departing from the scope of the invention.

What is claimed is:

1. Protective apparatus for use in delivery of oil and/or gas from a well through production tubing to a distribution system in a heavily trafficked environment, comprising:

a reinforced concrete bunker having a single chamber and an open top and substantially submerged in the earth in a position to surround the production tubing at near the upper end thereof;

a wellhead attached to the production tubing in a position to be completely enclosed within said bunker;

a top support structure attached to the inner walls of said concrete bunker at a position displaced from the top thereof;

a cover dimensioned to fit within the top of said concrete bunker and supported on said support structure at a position above said wellhead;

first and second access openings positioned substantially diametrically opposite to each other in said cover to each provide for both entry into the single chamber of said concrete bunker and through ventilation;

first and second ladders, one for each of said access openings attached to an inner wall of the chamber of said concrete bunker in a location such that the upper end of said ladder terminates in the vicinity of an access opening;

first and second hatch doors one for each of said access openings to close off said access openings; and a sump line attached to the inner wall of said concrete bunker and having one open end terminating at near the bottom of said bunker and a second open end extending from said bunker at a position above ground level.

2. Protective apparatus for use in the delivery of oil and/or gas as set forth in claim 1 including at least one vent in the cover to provide for continuous ventilation of the interior of said concrete bunker.

3. Apparatus for use in delivery of oil and/or gas from a well through production tubing to a distribution system, comprising:

a reinforced concrete bunker having a single chamber and an open top and substantially submerged in the earth in a position to surround a production tubing at near the upper end thereof;

a wellhead attached to the production tubing in a position to be completely enclosed within the chamber of said bunker;

a top support structure attached to the inner walls of said bunker at a position displaced from the top thereof;

a cover dimensioned to fit within the top of said concrete bunker and supported on said support structure at a position above said wellhead;

first and second access openings positioned substantially diametrically opposite to each other in said cover to each provide for both entry into the single chamber of said concrete bunker and through ventilation thereof;

first and second hatch doors one for each of said access openings to close off said access openings;

a service opening in said cover positioned to provide access to said wellhead, said service opening positioned in said cover between said first and second access openings; and a service cover removably fitted into said service opening to close off said opening.

* * * * *